US005967726A

United States Patent [19]

Turner et al.

[11] Patent Number: 5,967,726

[45] Date of Patent: Oct. 19, 1999

[54] CONTAINER-END TAB AND METHOD OF MANUFACTURING SAME

[75] Inventors: Timothy L. Turner, Cary; Randall G. Forrest, Park Ridge; Carlton Young, Westchester, all of Ill.

[73] Assignee: American National Can Company, Chicago, Ill.

[21] Appl. No.: 08/978,673

[22] Filed: Nov. 26, 1997

[51] Int. Cl.[6] ..... B21D 51/44

[52] U.S. Cl. ..... 413/25; 413/12; 220/269

[58] Field of Search ..... 413/12, 25, 15, 413/8, 56, 66, 67; 220/269, 273

[56] References Cited

U.S. PATENT DOCUMENTS

| | | | |
|---|---|---|---|
| Re. 31,702 | 10/1984 | Brown | 220/269 |
| D. 279,265 | 6/1985 | Turner et al. | D9/438 |
| 3,796,344 | 3/1974 | De Phillips et al. | 220/59 |
| 3,843,012 | 10/1974 | Brown | 220/269 |
| 3,850,124 | 11/1974 | Brown | 413/25 |
| 3,967,752 | 7/1976 | Cudzik | 220/269 |
| 4,015,744 | 4/1977 | Brown | 220/269 |
| 4,024,981 | 5/1977 | Brown | 220/269 |
| 4,030,631 | 6/1977 | Brown | 220/269 |
| 4,084,721 | 4/1978 | Perry | 220/269 |
| 4,130,074 | 12/1978 | Cudzik | 413/25 |
| 4,150,765 | 4/1979 | Mazurek | 220/269 |
| 4,184,607 | 1/1980 | Potts | 220/273 |
| 4,205,760 | 6/1980 | Hasegawa | 220/271 |
| 4,210,257 | 7/1980 | Radtke | 220/269 |
| 4,211,335 | 7/1980 | Langseder | 220/269 |
| 4,276,993 | 7/1981 | Hasegawa | 220/269 |
| 4,361,251 | 11/1982 | Langseder et al. | 220/269 |
| 4,465,204 | 8/1984 | Kaminski et al. | 220/269 |
| 4,530,631 | 7/1985 | Kaminski et al. | 220/269 |
| 4,535,909 | 8/1985 | Zysset | 220/273 |
| 4,596,342 | 6/1986 | Zysset | 220/273 |
| 4,762,579 | 8/1988 | Shimizu et al. | 413/12 X |
| 4,946,063 | 8/1990 | Heyes et al. | 220/270 |
| 5,119,664 | 6/1992 | Schubert | 72/356 |

FOREIGN PATENT DOCUMENTS 0704 382 A2 9/1995 European Pat. Off. .

*Primary Examiner*—James F. Coan

*Attorney, Agent, or Firm*—Wallenstein & Wagner, Ltd.

[57] ABSTRACT

The product and method of manufacturing a tab having a rivet island window and adapted to be secured to a container end, including the steps of forming a first dimple at a first end position of the window and a second dimple at a second end position of the window, formed as depressed regions of metal residing outside the central plane of the metal. The method includes punching a first blank in the first dimple and a second blank in the second dimple, and subsequently bending the edge regions around the first and second blank to form a bend of the metal away from the central plane. The central region of the window is formed between and joining the blanks, and a rivet opening is formed, adapted to receive a rivet for staking the tab to a container end.

20 Claims, 3 Drawing Sheets

FIG. 1
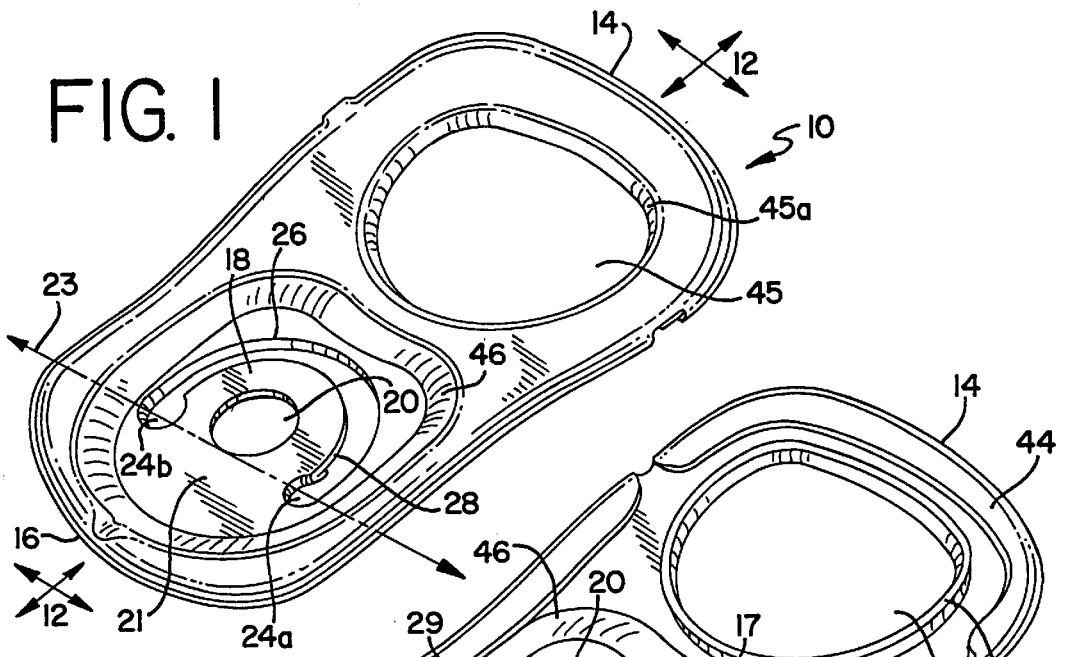
FIG. 2
FIG. 4
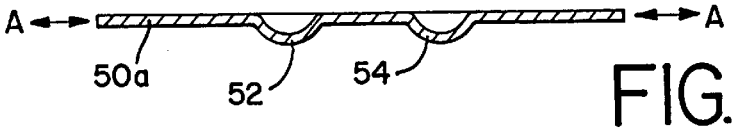
FIG. 5
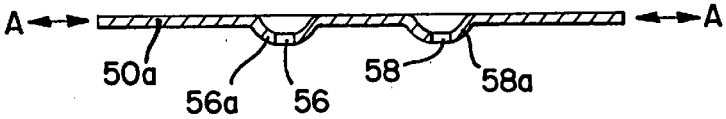
FIG. 6
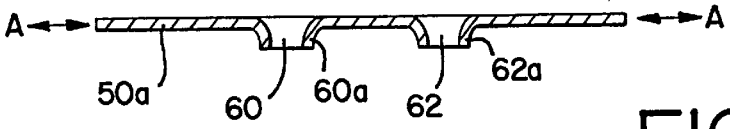
FIG. 7
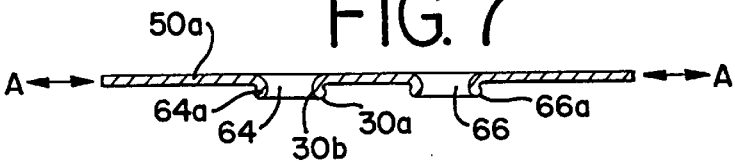

82
60
60a
62
62a
6
6
80
56
56a
58
58a
5
5
52
54
4
4
20
50
45
46
86
84
24a
24b
50
84
46
46
64
64a
66
66a
7
7
45a
45
44
14
45
22
20
24a
24b
40
16
50
44
42
40
90

CONTAINER-END TAB AND METHOD OF MANUFACTURING SAME

DESCRIPTION

1. Technical Field of the Invention

The present invention relates to the manufacture of an opening tab for container ends; specifically opening tabs for retained-tab beer and beverage container ends.

2. Background of the Invention

Pull tabs for container ends are used on various types of containers, including beer and beverage containers, food containers, and many other types of containers for household or industrial use. The most prevalent type of pull-tab container ends is the retained-tab end, which have a tab designed to remain on the container end after the container is opened, such as with beer and beverage metal containers. The typical beverage cans used today have a non-detachable tab, called the "ecology tab" because of the fact that the predecessor types of tabs were removed when the container is opened and were causing pollution concerns.

The typical non-detachable tabs used in the beverage container industry all are of generally the same design. These tabs have a nose portion, a lift end portion, separated by a central body portion that has an aperture provided for securing the tab to the end by a rivet. The tab is manufactured separately from the end, and is secured to the end such that the nose is positioned over the scoreline of the end. When the tab is lifted at the lift end by the user, the nose of the tab is pushed down on the end panel to fracture the score and open the container. The rivet, therefore, acts as a fulcrum for the rotation of the tab, and a central hinge area of the tab bends adjacent the rivet across a hinge line of the tab.

A major problem with the non-detachable tabs is the stress on the region at and around the hinge area. The hinge area must be pliable to facilitate easy bending for opening, yet it must withstand a great amount of the load on the tab when opening the container.

More specifically, the typical beer and beverage end tabs have a rivet island in the center of the tab, surrounding the opening that the rivet passes through. The rivet island is defined by a cut-out, or window, surrounding a large portion of the rivet. The window has terminal ends which define the hinge line in a tongue of metal. When the tab is lifted and the nose pushes against the end panel, the tongue of metal endures a great amount of stress and may fail by a fracture forming in the metal. This is exaggerated by the manner in which many users open a container. When a user opens a container rapidly, the pressurized contents of the container causes increased resistance from opening the container, resulting in greater load on the tongue of metal. Also, when the user exerts uneven lifting force at the lift end, i.e., a force that is not directly upward, more load is placed at one end of the window during the opening process. Further, the problem with maintaining the integrity of the tongue of metal is exaggerated by the ongoing down-gauging of metal used to manufacture the tabs. Whenever the thickness of the metal can be reduced, a significant amount of money may be saved. Therefore, the strength of the tab in the hinge-line region is one of the main limiting factors to down-gauging the metal of the tab.

One design used in attempt to alleviate this problem includes a manufacturing process in which the window was formed in stages. The terminal ends of the window are first formed by stamping out two small holes, and a piercing tool was then pushed through each hole to slightly bend the edge of each hole. This slight bend in the edge of the holes remained as a bent edge at the terminal ends of the window in the finished tab, providing resistance to the stresses on that region during use of the tab. However, because of the small width of the ends of the window, and the difficulty in bending the metal, this method results in only a very small bend in the metal at the window terminal ends. Therefore, an improved manufacturing method is desired, which will provide an increased bend of metal in the terminal ends of the window and to resist greater amount of stress and resist tearing.

SUMMARY OF THE INVENTION

It is an object of the present invention to provide a method of manufacturing a tab having a window with terminal ends that each have a collar of a curled edge for resisting stress and tearing. It is an object of the invention to form a first and a second dimple in a strip of metal, as a depressed region of metal residing outside the central plane of the strip, and to subsequently bend the edge regions of the dimples into a curl of the metal away from the central plane. It is further an object of the present invention to form such terminal ends of the window by forming blanks in the first and second dimple, and to subsequently form a central region of the window between and joining the first and second blank. It is also an object of the present invention to form the window ends by piercing the blanks with a piercing tool adapted to curl the edge regions and form widened openings of the blank, and to then collapse the curl of the edge regions to form a collar of a collapsed curl.

Other advantages and aspects of the invention will become apparent upon making reference to the specification, claims, and drawings to follow.

DESCRIPTION OF DRAWINGS

FIG. 1 is an elevated perspective view of the upper side of the tab according to the present invention;

FIG. 2 is an elevated perspective view of the under side of the tab according to the present invention;

FIG. 4 is a sectional view through 4—4 of FIG. 3;

FIG. 5 is a sectional view through 5—5 of FIG. 3;

FIG. 6 is a sectional view through 6—6 of FIG. 3;

FIG. 7 is a sectional view through 7—7 of FIG. 3;

DETAILED DESCRIPTION OF THE INVENTION

Figure 3:
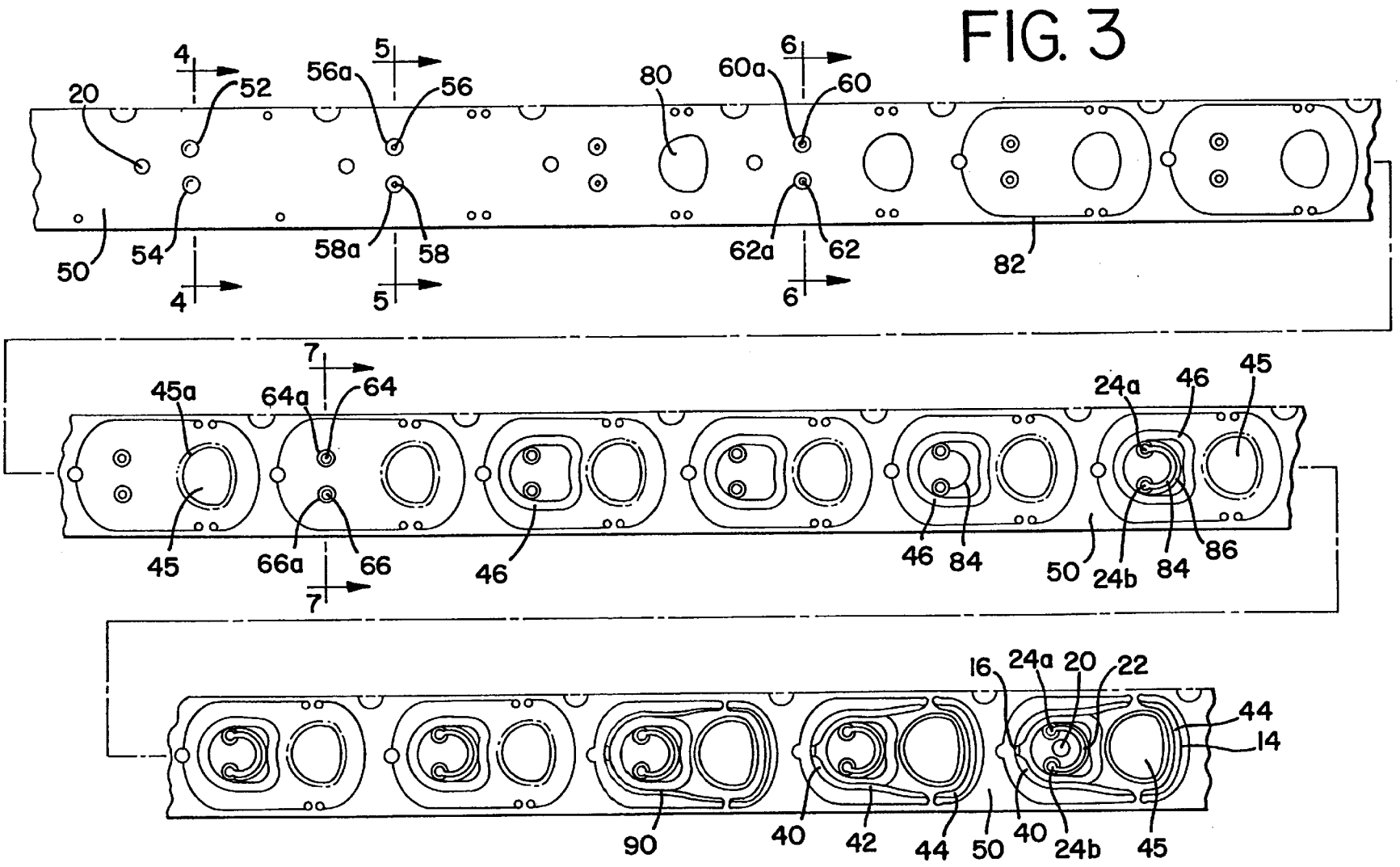
FIG. 3 is an underside plan view of a metal strip with a progression of the tab manufacturing steps of one embodiment of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

The present invention relates to the method of making an improved tab 10 for a retained-tab end for a container, and the structure of the tab 10 made according to such a method. The container end for a tab according to the present invention is a typically a beer and beverage container end, having a retained tab and, therefore, being identified as "ecology" or "easy-stay" container ends. However, it is contemplated that the present invention may be use with other types of container ends, such as food and other containers in which a lift-tab is useful to open the container.

The Tab

The tab 10 is constructed of a rigid material, typically aluminum alloy metal, and is substantially flat, generally disposed along a common plane 12. The tab 10 has a lift end 14 and a nose end 16 generally opposite the lift end 14, and a central body therebetween, with a central webbing region 17. The central webbing 17 of the tab 10 has a rivet island 18 with an aperture 20 adapted for receiving a rivet (not shown) to secure the tab to the central panel wall of a container end. The rivet island 18 is generally defined by hinge region 21 and a rivet island window 22, the window 22 preferably being a curvilinear shaped opening or void region having a first end 24*a* and a second end 24*b*. The hinge region 21 preferably appears as a tongue of the tab webbing 17 which joins the rivet island 18 to the remaining webbing 17. The hinge region 21 has a hinge line 23 between the first and second ends 24*a*, 24*b* of the window 22, preferably defined as a straight line therebetween.

The window 22 has a first edge 26 defining the outer side of the curvilinear opening and a second edge 28 defining the inner side of the curvilinear opening. The window 22 is preferably formed by lancing the metal and subsequently bending back the metal on either or both sides of the lance to form a widened opening, as is explained in greater detail below. The expansion of the lance by bending metal back, an operation called "wipe down," causes a bend 29 of the metal along the edge of the window 22, appearing as a fold or curl. Another practiced method of forming the window 22, although likely to result in lesser rigidity and stress resistance, is to merely stamp out a blank of metal in the shape of the window 22, without any bending of the edges of the window 22.

The primary aspect of the present invention permits one to form bends (also as curls or folds) of metal in the first and second terminal ends 24*a*, 24*b* of the window 22. The bend of metal in the ends of the window 22, referred to henceforth as the curl 30 in the edges of the ends 24*a*, 24*b* of the window 22, provides a collar in the edges, as a structural component to increase the strength of the metal in the ends 24*a*, 24*b* and to resist stresses and prevent tearing during use of the tab 10. This added strength is primarily provided by the curl 30 providing an alteration in the direction of the metal, by bending the metal to a direction outside the planar path of the webbing region. With such alteration in the directional orientation of the metal in the ends 24*a*, 24*b*, the metal in the region of the curl 30 has an increased resistance to the sheer forces on the metal when the tab 10 is used for opening the container end. It is also believed that added strength in the ends 24*a*, 24*b*, is provided by the residual stress state of the metal in and around the curl 30.

The curl 30 according to the present invention, is made by the manufacturing process that includes first forming a dimple in the metal in the region of the window ends 24*a*, 24*b*, and subsequently bending the metal of the dimple back. The means for bending back the metal of the dimple may be done by forming a blank in the dimple and subsequently curling back the edges of the blank, as is described in detail in the preferred embodiment. Instead, the means for bending back the metal of the dimple may include curling the metal back with a tapered tool after cutting out (blanking) the shape of the window 22, as described above as an alternative to a "lance and wipe down" method of forming the window 22. Also, another means for bending back the metal of the dimple may be done by piercing the metal of the dimple 52, 54 with a tapered piercing tool that punctures and curls the metal, as is described further below. The result of this method is to create terminal ends 24*a*, 24*b* of the window 22 which have apertures (shown in FIG. 7 as 64 and 66), and a collar formed of a fold of the metal (64*a* and 66*a* in FIG. 7) which alters the direction if the metal to curl outside the plane of the metal in the webbing region 17. Preferably, the collar, formed of the curl 30 of metal, has a curl width 30*a* in the range of 0.028 inch to 0.038 inch, and a curl height 30*b* in the range of 0.020 inch to 0.030 inch.

As is best shown in FIG. 2, the nose end 16 has a nose 40 of folded, or curled, metal. The folded metal of the nose 40 is preferably integral with a folded edge 42 of the outer periphery of the tab. The lift end 14 of the tab 10 also has a folded edge 44. The folded edge 40 of the nose 16 and the similar folded edge of the outer periphery 42 and the lift end 44, have a bend of the metal and are adapted to provide strength of the tab 10 to resist stress from outside the plane 12. The tab 10 also has a finger hole 45, preferably being defined by an inner folded, or curled, edge 45*a*, which provides a smooth inner edge of the finger hole 45 and strengthens the metal of the outer periphery of the finger hole 45.

The central webbing 17 preferably has a deboss bend 46, a sloped region of the metal which results in a central deboss region of the central webbing 17 inward of the deboss bend 46. This deboss region provides a lowered plane of the metal in the central webbing 17. This structure of the tab central webbing 17 is adapted to lower the rivet island 18, such that the lower surface 18*a* of the rivet island 18 is positioned directly against the central panel of the container end (not shown), secured to the end panel by a rivet (not shown) passing through the rivet island opening 20, and staked thereto by stamping the top of the rivet. The tab 10 is secured in this manner in a position whereby the nose 16 extends partially over the tear panel of the end panel (not shown) and the hinge line 23 of the tab 10 is generally aligned with the proximal edge of the tear panel.

In operation, the tab 10 is lifted at the lift end 14, operable by the user's finger applying a lifting force at the lift end 14. Lifting the lift end 14 forces the nose 16 of the tab 10 downward, to force the nose 16 against the tear panel of the end. Because the rivet maintains the rivet island 18 against the end panel, the tab 10 remains attached to the end and bends across the hinge line 23 of the tongue 21 of the central webbing region. 17. The collar 64*a*, 66*a* of each terminal end 24*a*, 24*b* of the window 22 provides resistance to tearing of the metal across the hinge line 23 during use of the tab 10.

The Method Of Making The Tab

As shown in FIG. 3, and FIGS. 4–11, the preferred embodiment of the method of manufacturing the tab 10 according to the present invention includes the steps of: (1) first providing an elongated strip of plate metal 50 having a thickness 50*a* along a central plane A—A; (2) forming a first dimple 52 in the metal strip 50 at a first end position 24*a* of the window 22, and second dimple 54 at a second end position 24*b* of the window 22; (3) bending back the metal in the dimples 52, 54, preferably by: (3*a*) forming a first and second blank 56, 58 (FIG. 5) generally in the center of the respective dimple 52, 54, the first and second blank 56, 58 each being an aperture with an area of the dimples 52, 54 forming an edge region 56*a,* 58*a* surrounding each blank 56, 58; then, (3*b*) bending the edge regions 56*a,* 58*a* of the first and second blank 56, 58 to form a widened first and second blank opening 60, 62 (FIG. 6), each with a bend 60*a,* 62*a* in the metal of the edge regions, bent away from the central plane A—A of the metal strip 50; and, (4) bending the edge regions to a further widened opening 64, 66 (FIG. 7) having an increased bend, or curl, 64*a,* 66*a* in the edge regions.

The final operation of further bending the edge regions 56*a,* 58*a* of the blank aperture results in curled edges 64*a,* 66*a,* each having a curl height 30*b* and a curl width 30*a*. Preferably, the curl height 30*b* is in the range of 0.020 to 0.030 inch and the curl width 30*a* is in the range of 0.028 to 0.038 inch. This method results in an increased curl 64*a,* 66*a* of the window ends 24*a,* 24*b* from that which is otherwise obtainable, due to the fact that dimples 52, 54 were first formed to position the edges of the blank 56*a,* 58*a* outside the plane A—A of the metal strip 50. The steps of forming these ends 24*a,* 24*b* of the window 22 are preferably performed prior to the formation of the remainder of the window 22.

Figure 8:
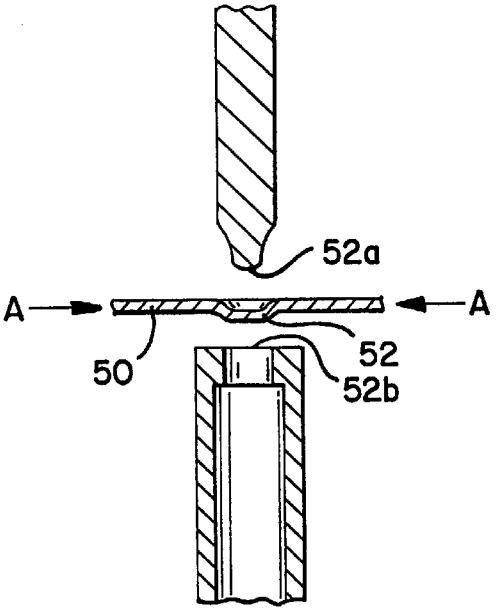
FIG. 8 is a side cross-sectional view during the method of forming the dimples shown in FIG. 4.

The first step in the preferred embodiment of the method, the formation of the dimples 52, 54, is best shown in FIGS. 4 and 8. The dimples 52, 54 are preferably approximately 0.090 to 0.100 inch in diameter, and approximately 0.015 to 0.025 inch deep. As shown in FIG. 8, each dimple (represented by the left dimple shown in FIGS. 3 and 4) 52 is preferably formed by bending the metal 50 between a punch 52*a* acting as a male die, and an anvil 52*b* as a female die. In the preferred embodiment, the punch 52*a* has an outer diameter of approximately 0.096 inch, and the anvil 52*b* has an opening at its end which is at least 0.096 inch. During the step of forming the dimple 52, the punch 52*a* pushes the metal 50 into the opening of the anvil 52*b* to form the dimple 52 of metal positioned below the plane A—A of the metal 50. Although the dimples 52, 54 shown in FIGS. 4 and 8 do not depict coining or thinning of the metal, the dimples 52, 54 may alternatively include thinning of the metal. Such thinning of the metal may be formed by coining the metal in the region of the dimples by squeezing the metal between the upper die 52*a* and an anvil surface of the lower die 52*b*.

Figure 9:
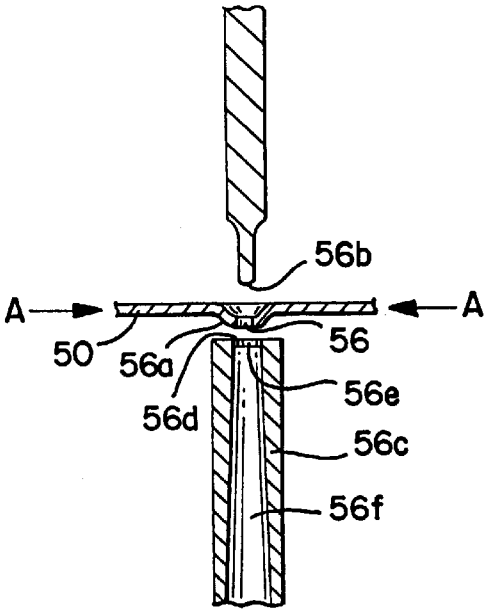
FIG. 9 is a side cross-sectional view during the method of forming the blanks shown in FIG. 5.

The step of forming blanks 56, 58, best shown in FIGS. 5 and 9, is preferably done next. In the step of forming the blanks, the incised blanks 56, 58 are preferably openings stamped from the metal strip 50 with a diameter of approximately 0.035 to 0.045 inch. Because only a central area of the dimple 52 is removed by the blanking operation, to thereby remove a slug (not shown) of metal, an edge region 56*a* of the dimple remains and at least partially surrounds the blank 56. As shown in FIG. 9 (again depicting the blank at only one end of the window), the blank 56 is formed by punching out a slug of metal within the dimple 52 with a banking punch 56*b,* while supporting the metal with an blanking anvil 56*c*.

In the preferred embodiment of the method, the blanking punch 56*b* has an outer diameter the size of the desired blank diameter, i.e., in the range of 0.035 to 0.045 inch. The blanking anvil 56*c* preferably has a supporting surface 56*d* which supports at least the metal of the dimple which will remain as the edge region 56*a,* and has an aperture 56*e* adapted to permit the blanking punch 56*b* to be at least partially received into the blanking anvil 56*c*. The aperture 56*e* in the blanking anvil has an end region which is preferably only slightly greater than the outer diameter of the punch 56*b* to provide adequate clearance between the punch 56*b* and the anvil 56*c*. For example, when using a blanking punch 56*b* with an outer diameter of 0.040 inch, the end region of the aperture 56*e* should have an inner diameter slightly greater than 0.040 inch, and preferably approximately 0.043 inch.

The aperture 56*e* of the blanking anvil 56*c* also preferably has a channel 56*f* continuing from the end region to allow the metal slug to pass through the anvil 56*c* for efficient collection of the slugs.

In the embodiment shown in FIG. 3, the finger opening blank 80 is then formed, preferably incised by a finger hole punch operation. The rivet opening 20 is also formed in an early sequence of the manufacturing process. In this manner, the early stages of the manufacturing process includes many of the steps that require the formation of an opening by cutting a blank of metal. This is beneficial to the manufacture of the tab 10 because the metal slugs are easily discarded in the early stages of the manufacturing process, primarily due to the design of the presses used to manufacture tabs.

An optional sequence of this method is contemplated whereby the blanks 56, 58 may first be formed, and the edges thereof 56*a,* 58*a* may then be bent into the dimple formation between mating dies. Such alternative methods of this invention, without formation of blanks prior to window formation, are described further below.

Figure 10:
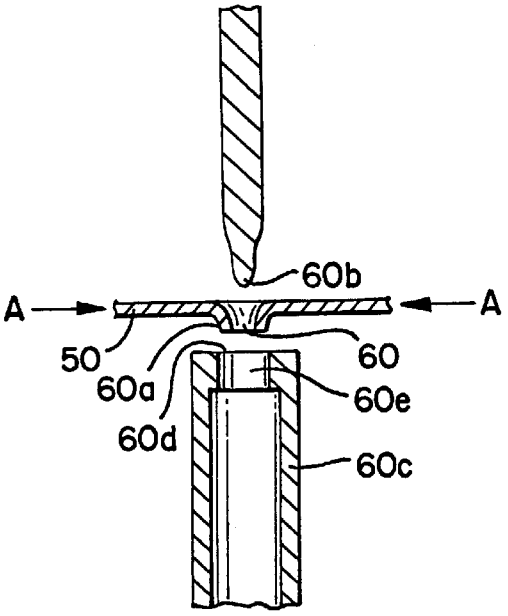
FIG. 10 is a side cross-sectional view during the method of piercing the blanks to form the widened blanks shown in FIG. 6.

As is best shown in FIGS. 6 and 10, the step of forming the widened blanks 60, 62 (FIG. 6) is then performed by punching a tapered tool 60*b* through the blank openings 56, 58 of the prior operation. The widened openings 60, 62 preferably have a diameter of approximately 0.062 to 0.072 inch. As shown in FIG. 10 (representing only one side of the window ends), the widened diameter of the widened blank 60 is formed by piercing the blank with a tapered piercing tool 60*b,* while supporting the metal 50 on an upper surface 60*d* of a piercing anvil 60*c*. The upper surface 60*d* of the piercing anvil 60*c* surrounds an opening 60*e* adapted to at least partially receive the piercing tool 60*b*. When the piercing tool 60*b* is advanced through the blank and into the piercing anvil 60*c,* the tapered surface of the piercing tool 60*b* causes the edge of the blank to form a bend 60*a* away from the central plane A—A of the metal, thereby resulting in a widened blank 60 with an edge formed into a bend 60*a*. In the embodiment of the method shown in FIG. 3, the outer shape of the tab cut-out is then formed by a lancing operation with a lance tool (not shown). Also, the embodiment shown then includes a wipe-down step whereby the edge of the finger opening blank 80 is bent down to form the edge 45*a* of the finger hole 45.

The next step performed is that of further widening the blank openings to form expanded openings 64, 66, each surrounded by a collar 64*a,* 66*a*. This step of forming expanded blanks 64, 66 preferably includes some degree of collapsing the bend 60*a* of metal located at the edge of the widened blank 60, which was preferably formed by the piercing operation described above. Collapsing the bend 60*a* is preferably performed between mating dies 64*b,* 64*c,* resulting in an expanded opening with an inner diameter of approximately 0.056 to 0.066 inch, and curled edges of each collar 64*a,* 66*a* having a curl height 30*b* in the range of 0.020 to 0.030 inch and a curl width 30*a* is in the range of 0.028 to 0.038 inch.

Figure 11:
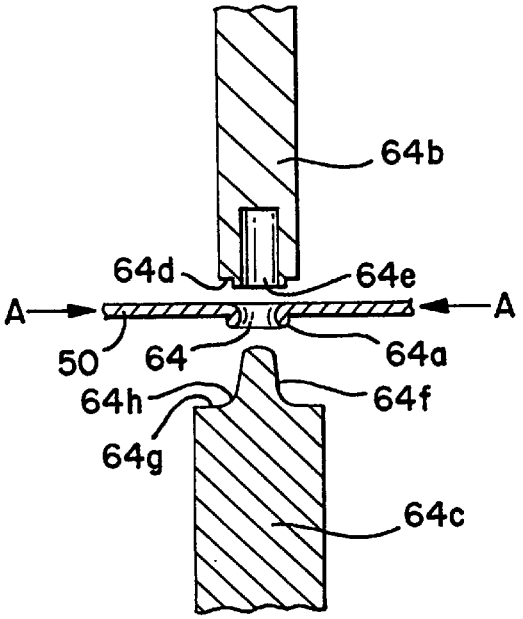
FIG. 11 is a side cross-sectional view during the method of collapsing the curled edges of the blanks to form the collar shown in FIG. 5.

In the preferred embodiment, as best shown in FIG. 11, a supporting anvil 64*b* is positioned against the metal 50, and a curling die 64*c* is positioned against the metal 50, opposite the anvil 64*b*. The supporting anvil 64*b* has a supporting anvil surface 64*d* which is adapted to support the metal 50 opposite the curled edge region 64*a*. The supporting anvil 64*b* preferably also has a recess 64*e*, adapted to receive the projection 64*f* of the curling die 64*c*, described below. The curling die 64*c* preferably has a projection 64*f* having a tapered outer diameter adapted to expand the blank opening 64 as the projection 64*f* is advanced into the blank 64. The curling die also has an outer base surface 64*g* which is positioned substantially parallel the metal 50 and the supporting anvil surface 64*d*. A curling surface 64*h* joins the base surface 64*g* and the tapered projection 64*f*.

During this step of the method, the metal 50 is supported on the surface 64*d* of the anvil 64*b*, as the curling die 64*c* is advanced such that the projection 64*f* passes through the blank 64. As the curling die 64*c* is advanced further, the edge of the blank 64*a* (which preferably has been formed into a curled edge 60*a* by the previous operation, FIG. 10) is bent by contact with the curling surface 64*h*, and is then collapsed into an increased bend or curl by contact with the base surface 64*g* and by compressive force between the base surface 64*h* and the anvil surface 64*d* of the anvil die 64*b*.

In the embodiment shown in FIG. 3, after the ends 24*a*, 24*b* of the window 22 are complete, the remainder of the window is formed by forming a curvilinear lance 84, and subsequently performing one or more wipe-down operations to form a bent edge 86 of the window 22. The remainder of the window may also be formed merely by a blanking (or cut-out) step, whereby a blank of the metal is cut out in the desired final shape of the window 22, shown herein as a curved window 22. Also, the deboss 46 of the central webbing is formed, causing at least a portion of the central webbing to be positioned below the plane A—A of the remaining plate metal 50.

An alternative embodiment of the method of bending back the metal of the dimples 52, 54 includes stamping out (blanking) the shape of the window 22 such that the ends of the blanked window 22 are in the dimple areas 52, 54, and then bending back the metal in the dimples with a wipe-down or tapered tool operation. This method, therefore, is useful when the window 22 is not formed by a "lance and wipe down" method but, instead, is formed by merely blanking out the general shape of the window 22.

Another alternative embodiment of the process serving as a means for bending back the metal of the dimples 52, 54 includes piercing the metal with a piercing tool that punctures the metal in each dimple 52, 54. The piercing tool is preferably adapted to have a piercing tip to puncture the metal, and is tapered to at least partially bend or curl back the metal in the dimples 52, 54 as the piercing tool is advanced beyond the initial puncture of metal. Preferably a mating die is useful to support the metal of the dimple, opposite the piercing tool.

Other operations in the tab manufacturing process are shown in FIG. 3 as performed in the latter stages of the process. These include a wipe-down operation to form a bend 90 of the lance cut-out 82, and the subsequent curling of the bend to form the fold, or curl, of the tab nose 40, the outer periphery 42 and the lift end 44.

While specific embodiments have been illustrated and described, numerous modifications come to mind without significantly departing from the spirit of the invention and the scope of protection is only limited by the scope of the accompanying claims.

We claim:

1. The method of manufacturing a tab having a rivet island window and adapted to be secured to a container end, comprising the steps of;

providing an elongated strip of plate metal having a thickness along a central plane;

forming a first dimple at a first end position of the window, and forming a second dimple at a second end position of the window;

punching a first blank within the first dimple and punching a second blank within the second dimple, said first and second blank each being an aperture having an edge region of dimple surrounding the blank after forming said first blank and said second blank, bending said edge regions of the first and second dimple to form a bend of the metal away from the central plane.

2. The method of claim 1, wherein;

the step of punching a first blank within the first dimple and punching a second blank within the second dimple further comprises forming apertures by a blanking punch having an incising diameter for removing a slug of metal in central area of the first and second dimple.

3. The method of claim 1, wherein the step of bending edge regions of the first and second dimple includes the steps of;

piercing the first and second blank aperture with a tapered piercing tool and advancing said tapered tool to form a bend of metal in the edge region of each said dimple.

4. The method of claim 1, wherein, prior to the step of bending edge regions of the first and second dimple, further comprising the steps of;

forming a central region of the window as an opening between the first and second dimple.

5. The method of claim 1, further comprising the steps of;

forming a central region of the window by lancing the metal to form a lance separation of the metal in said central region between each of said blank apertures, the lance having a first edge area and a second edge area; and, widening the lance separation by bending the metal immediately adjacent the first edge area of the lance away from said central plane to form a curl.

6. The method of claim 1, further comprising the steps of;

forming a central region of the window by punching a curvilinear opening in the metal in the area between and joining the first and second blank apertures.

7. The method of claim 1 wherein the step of punching a first blank within the first dimple and punching a second blank within the second dimple includes forming apertures, each having a diameter approximately 0.035 to 0.045 inch.

8. A tab for a beverage container end made according to the method of claim 1.

9. The method of manufacturing a tab having a rivet island window and adapted to be secured to a container end, comprising the steps of;

providing an elongated strip of plate metal having a thickness along a central plane;

forming a first dimple at a first end position of the window and a second dimple at a second end position of the window, said first and second dimple being a depressed region of metal residing outside the central plane;

punching a first blank in the first dimple and a second blank in the second dimple, each of said first and second blank being an aperture in a portion of the dimple and being formed by a blanking punch having an incising diameter for removing a slug of metal in central area of the first and second dimple, each dimple having an edge region surrounding the blank;

bending the edge regions of the first and second dimple to form a bend of the metal away from the central plane;

forming a central region of the window between and joining the first and second blank; and punching a rivet opening in the rivet island, the rivet opening being adapted to receive a rivet for staking the tab to a container end.

10. The method of claim 9 wherein the step of bending the edge regions of said first and second dimples comprises;

piercing the blanks with a piercing tool adapted to curl the edge regions and form widened openings of said blank.

11. The method of claim 9 further comprising the steps of;

after the step of bending the edge regions, collapsing the bend of the edge regions to form a collar with an enhanced bend.

12. A tab for a beverage container end made according to the method of claim 9.

13. A tab for a beverage container end made according to the method of claim 11.

14. The method of claim 9 wherein the step of punching a first blank in the first dimple and a second blank in the second dimple includes removing a slug of metal having a diameter approximately 0.035 to 0.045 inch.

15. The method of manufacturing a tab having a rivet island window and adapted to be secured to a container end, comprising the steps of;

providing an elongated strip of plate metal having a thickness along a central plane;

forming a first dimple at a first end position of the window, and forming a second dimple at a second end position of the window;

bending edge regions of the first and second dimple to form a bend of the metal away from the central plane;

after the step of bending the edge regions of the first and second dimple to form a bend of the metal, collapsing the bend of the edge regions to form a collar with an enhanced bend.

16. A tab for a beverage container end made according to the method of claim 15.

17. The method of manufacturing a tab having a rivet island window and adapted to be secured to a container end, comprising the steps of;

providing an elongated strip of plate metal having a thickness along a central plane;

forming a first dimple at a first end position of the window and a second dimple at a second end position of the window, said first and second dimple being a depressed region of metal residing outside the central plane;

punching a first blank in the first dimple and a second blank in the second dimple, each of said first and second blank being an aperture in a portion of the dimple, each dimple having an edge region surrounding the blank;

bending the edge regions of the first and second dimple to form a bend of the metal away from the central plane;

forming a central region of the window between and joining the first and second blank;

punching a rivet opening in the rivet island, the rivet opening being adapted to receive a rivet for staking the tab to a container end; and, after the step of bending the edge regions, collapsing the bend of the edge regions to form a collar with an enhanced bend.

18. The method of manufacturing a tab having a rivet island window and adapted to be secured to a container end, comprising the steps of;

providing an elongated strip of plate metal having a thickness along a central plane;

forming a first dimple at a first end position of the window and a second dimple at a second end position of the window, said first and second dimple being a depressed region of metal residing outside the central plane;

punching a first blank in the first dimple and a second blank in the second dimple, each of said first and second blank being an aperture in a portion of the dimple, each dimple having an edge region surrounding the blank;

bending the edge regions of the first and second dimple to form a bend of the metal away from the central plane;

forming a central region of the window between and joining the first and second blank;

punching a rivet opening in the rivet island, the rivet opening being adapted to receive a rivet for staking the tab to a container end;

piercing the blanks with a piercing tool adapted to curl the edge regions and form widened openings of said blank; and, after the step of bending the edge regions, collapsing the bend of the edge regions to form a collar with an enhanced bend.

19. A tab constructed of rigid material and adapted for attachment to a retained-tab container end, comprising;

a hinge region generally disposed along a central plane and having a rivet island window and with a first end and a second end;

an edge region of each said first and second end of the window, each said edge region being curled away from the central plane to form a collar having a curl width in the range of 0.028 to 0.038 inch and a curl height in the range of 0.020 to 0.030 inch.

20. The tab of claim 13, wherein the collar is formed by curling a first and second dimple in the hinge region to form a bend of the metal away from the central plane and subsequently collapsing the bend of metal.

* * * * *